United States Patent [19]

Bennett et al.

[11] 4,411,376

[45] Oct. 25, 1983

[54] LIQUID SOAP DISPENSER

[76] Inventors: Robert A. Bennett, 170 Sturbridge Rd., Easton, 06425; Walter S. Nuckols, 119 Putnam Rd., Bethel, Conn. 06801

[21] Appl. No.: 319,304

[22] Filed: Nov. 9, 1981

[51] Int. Cl.[3] ..... B65D 37/00

[52] U.S. Cl. ..... 222/212; 132/88.5; 222/206; 222/491

[58] Field of Search ..... 222/212, 213, 491, 492, 222/542, 494, 496, 206, 215, 78; 401/143, 183, 186; 132/88.5

[56] References Cited

U.S. PATENT DOCUMENTS

| | | | |
|---|---|---|---|
| 2,132,735 | 10/1938 | Huston | 222/544 X |
| 3,143,755 | 8/1964 | Rowley | 222/206 X |
| 3,214,783 | 11/1965 | Perry et al. | 401/186 X |
| 3,231,145 | 1/1966 | Converse | 401/186 X |
| 3,319,837 | 5/1967 | Mueller | 222/212 X |
| 3,880,532 | 4/1975 | O'Hare | 401/186 X |

*Primary Examiner*—Robert B. Reeves
*Assistant Examiner*—Russell D. Stormer

[57] ABSTRACT

A hollow flexible body containing liquid soap has the general shape of a bar of soap. The body has opposite front and rear main surfaces interconnected by a peripheral surface. A groove defining a closed loop extends along the main surfaces and across the peripheral surface. The groove carries a discharge port. When the body is squeezed, soap is discharged through the port. An O ring is disposed in the groove and overlies the opening. The O ring seals the port when soap is not dispensed and cooperates with the groove to distribute the soap when it is dispensed.

6 Claims, 10 Drawing Figures

FIG. 1
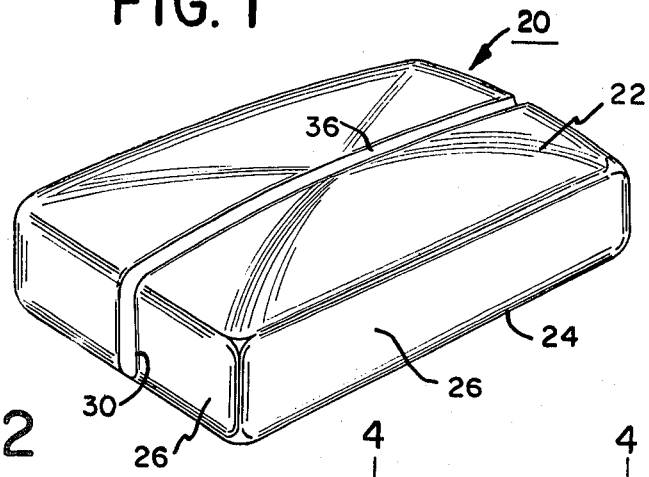
FIG. 6
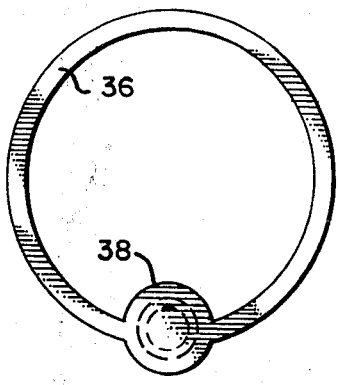
FIG. 2
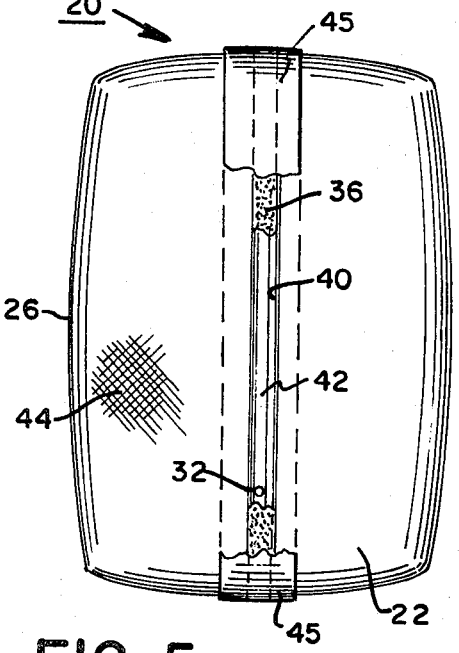
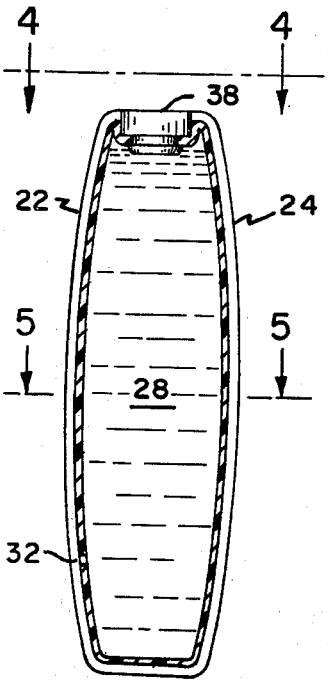
FIG. 7
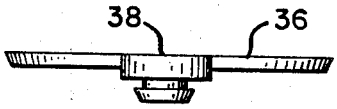
FIG. 8
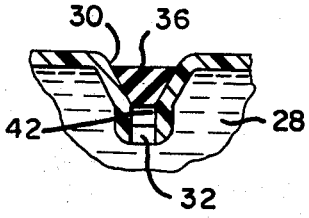
FIG. 5
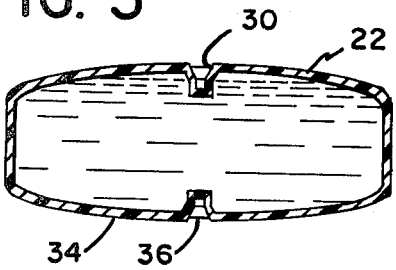
FIG. 3
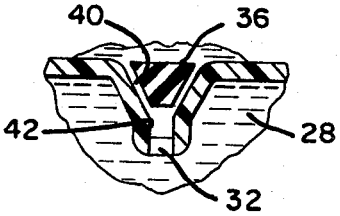
FIG. 9
FIG. 4
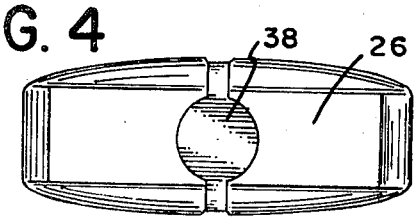
FIG. 10
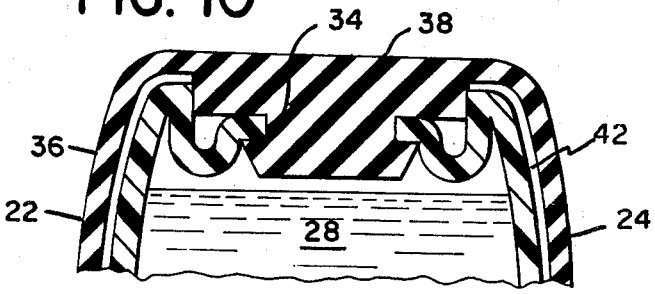

LIQUID SOAP DISPENSER

SUMMARY OF THE INVENTION

This invention is directed toward an inexpensive liquid soap dispenser which can be readily disposed of when all the soap has been used up and which is shaped and sized for ease and convenience of use.

To this end, a hollow flexible body adapted to contain liquid soap has the general shape of a bar of soap, with oppositely disposed spaced apart front and rear main surfaces connected along their edges by a continuous peripheral surface which extends between these main surfaces at right angles thereto. The body is provided with a groove defining a closed loop which extends across the main surfaces and the peripheral surface.

The body has a discharge port disposed in the groove which communicates with the interior of the body whereby when the body contains soap and is squeezed, the soap is discharged through the port.

A flexible O-ring is disposed in the groove and overlies the opening. The ring has a raised position in the groove when the body is squeezed to dispense soap and otherwise has a lowered position in the groove.

The ring and groove and port all cooperate whereby the port is sealed and soap cannot leak out except when the body is squeezed. The ring and groove cooperate to properly distribute the soap as it is discharged and also cooperate to establish a proper path for return air flow.

BRIEF DESCRIPTION OF THE DRAWINGS

FIG. 1 is a perspective view of the invention.

FIG. 2 is a top view thereof.

FIG. 3 is a longitudinal cross section thereof.

FIG. 4 is a view taken along line 4—4 in FIG. 3.

FIG. 5 is a view taken along line 5—5 in FIG. 3.

FIG. 6 is a plan view of an O-ring and sealing plug used in the invention.

FIG. 7 is a side view of the ring and plug of FIG. 6.

FIG. 8 is a detail view of the ring position when the invention is not in use.

FIG. 9 is a view similar to FIG. 8 but illustrating the ring position while soap is being dispensed.

FIG. 10 is a detail view illustrating the fill opening prior to insertion of the sealing plug.

DETAILED DESCRIPTION OF THE PREFERRED EMBODIMENT

Referring now to FIGS. 1–10, a hollow flexible integral body of polypropalene or similar plastic shown generally at 20 has opposite spaced apart main front and rear surfaces 22 and 24 connected along their edges by a continuous peripheral surface 26 extending between these main surfaces at right angles thereto. The body is filled with liquid soap 28. The body has a continuous groove 30 which extends longitudinally along the center lines of the main surfaces and transversely across the peripheral surface. The peripheral surface has one or more small discharge port 32s disposed in the groove and the top portion contains a fill opening 34 much larger in area than the port 32. A preferred position for a single port is the bottom portion of the peripheral surface.

A flexible O-ring 36 has a flexible sealing plug 38 secured thereto. The ring is disposed in the groove with plug 38 snap fitted into sealing position into opening 34. Removable tape 45 keeps O-ring 36 in sealing position during shipping. Tape 45 must be removed before use.

The groove in transverse cross section has an upper section 40 which defines an inverted trapezoid and a lower connecting portion 42 which defines a rectangle, typically a square 1/32 inch on a side. The O-ring in transverse cross section defines an inverted trapezoid. The ring has a lowered position when the dispenser is not in use (FIG. 8) in which it bears against the walls of the upper portion of the groove, leaving the lower portion 42 of the groove open. The base of the trapezoid of the ring is disposed 1/32 inch below the top of the upper section of the groove.

When the body is squeezed and soap flows out of the discharge port, the ring is raised and it moves out of contact with the walls of the groove.

When soap is dispensed, it flows along the lower portion 42 of the groove as well as between the ring and the walls of the groove. After the soap has been dispensed and used, portion 42 forms a channel through which air flows to return through the port into the interior of the body.

One of surfaces 22 and 24 can be smooth while the other can have a roughened region 44 which can provide a brushing type of cleaning action.

What is claimed is:

1. A soap dispenser comprising:

a hollow flexible body adapted to contain liquid soap, said body having the general shape of a bar of soap with oppositely disposed spaced apart main front and rear surfaces connected along their edges by a continuous peripheral surface which extends between these main surfaces at right angles thereto, the said body carrying a groove which defines a closed loop and extends across the main surfaces and the peripheral surface, said groove being disposed in the middle of the main surfaces, said body having a discharge port disposed in the peripheral surface and in said groove, said port communicating with the interior of the body, whereby when said body contains soap and is squeezed said soap is discharged through said port, said body having a fill opening in said peripheral surface, spaced apart from said port and much larger than said port, through which said soap can be poured into said body; and a flexible O-ring disposed in said groove and overlying said opening, said ring having a raised position in said groove when the body is squeezed to dispense soap and otherwise having a lowered position in said groove, said O-ring carrying a sealing plug which is snap fitted into sealing engagement with said opening.

2. The dispenser of claim 1 wherein said groove in transverse cross section has an upper portion in the shape of an inverted trapezoid and a lower section in the shape of a rectangle and wherein said O-ring in transverse cross section has the shape of an inverted trapezoid, said O-ring when in lowered position engaging the walls of the upper portion of the groove and when in raised position being spaced from said walls.

3. The dispenser of claim 2 wherein the base of the O-ring trapezoid is disposed below the base of the groove trapezoid when the O-ring is in lowered position.

4. The dispenser of claim 3 wherein one portion of the peripheral surface of the body is designated as the bottom, said port being disposed in said bottom.

5. The dispenser of claim 4 wherein an opposite portion of the peripheral surface is designated as the top and contains the opening.

6. The dispenser of claim 5 wherein one of said main surfaces has a roughened area.

* * * * *